United States Patent [19]

Verhoeven et al.

[11] Patent Number: 5,043,025

[45] Date of Patent: Aug. 27, 1991

[54] HIGH STRENGTH-HIGH CONDUCTIVITY CU—FE COMPOSITES PRODUCED BY POWDER COMPACTION/MECHANICAL REDUCTION

[75] Inventors: John D. Verhoeven; William A. Spitzig; Edwin D. Gibson; Iver E. Anderson, all of Ames, Iowa

[73] Assignee: Iowa State University Research Foundation, Inc., Ames, Iowa

[21] Appl. No.: 536,450

[22] Filed: Jun. 12, 1990

[51] Int. Cl.[5] ..... B22F 3/18

[52] U.S. Cl. ..... 148/11.5 P; 419/23; 419/28; 419/31; 419/68

[58] Field of Search ..... 148/11.5 P; 419/23, 419/28, 31, 68

[56] References Cited

U.S. PATENT DOCUMENTS

| | | | |
|---|---|---|---|
| 3,773,474 | 11/1973 | Horn et al. | 419/3 |
| 4,378,330 | 3/1983 | Verhoeven et al. | 420/432 |
| 4,481,030 | 11/1984 | Schmidt et al. | 75/10.23 |
| 4,569,404 | 4/1987 | Butt | 419/65 |
| 4,604,259 | 8/1986 | Whitman | 419/66 |
| 4,627,959 | 12/1986 | Gilman et al. | 420/533 |
| 4,770,718 | 9/1988 | Verhoeven et al. | 419/66 |

FOREIGN PATENT DOCUMENTS 0170867 2/1986 European Pat. Off. .

OTHER PUBLICATIONS

J. D. Verhoeven et al., "Copper Refractory Metal Alloys", J. Metals 38, 20, 1986.

Mechanical Properties of Cu-Based Composites With In Situ Formed Ultrafine Filiaments, 1982, J. V. Beck et al.

J. D. Verhoeven et al. Deformation Processed Cu-Refractory Metal Composites, *Mat & Mft. Proc.*, 4, pp. 197-209, 1989.

The Emissivity of Etched Cu—Nb In-Situ Alloys. Verhoeven et al., 4-1, 1987.

Characteristics of P/M Processed Cu—Nd Composite, C. L. Trybus et al., 1988.

Anomalus Increase In Strength of In Situ Formed Cu—Nb Multifilamentary Composites, Bevk et al, Dec. 1978.

Fabricability of and Microstructural Development In Cold Worked Metal Matrix Composites. P. D. Funkenbusch et al., vol. 18, 1984.

Development of High Performance Superconductors By Powder Metallurgy, S. Foner.

A Comparison of the Strength and Microstructure of Heavily Cold Worked Cu-20% Nb Composites Formed By Different Melting Procedures, Spitzig et al.

The Senistivity and Microstructure of Heavily Drawn Cu—Nb Alloys, Verhoeven et al., 1989.

Microstructure Strengthening In Cold Worked In Situ Cu-14.8 vol. % Fe Composites, 1981, Funkenbusch.

Elevated Temperature Microstructural Stability of Heavily Cold Worked In-Situ Composites, p. 287, 1986. J. C. Malzahn et al.

Strength and Conductivity of In Situ Cu—Fe Alloys, May 5, 1989, J. D. Verhoeven et al.

*Primary Examiner*—R. Dean

*Assistant Examiner*—David W. Schumaker

*Attorney, Agent, or Firm*—Tilton, Fallon, Lungmus & Chestnut

[57] ABSTRACT

A particulate mixture of Cu and Fe is compacted and mechanically reduced to form an "in-situ" Cu-Fe composite having high strength and high conductivity. Compaction and mechanical reduction of the particulate mixture are carried out at a temperature and time at temperature selected to avoid dissolution of Fe into the Cu matrix particulates to a harmful extent that substantially degrades the conductivity of the Cu-Fe composite.

14 Claims, 4 Drawing Sheets

HIGH STRENGTH-HIGH CONDUCTIVITY CU—FE COMPOSITES PRODUCED BY POWDER COMPACTION/MECHANICAL REDUCTION

CONTRACTURAL ORIGIN OF THE INVENTION

The U.S. Government has rights in this invention pursuant to Contract No. W-7405-ENG-82 between the U.S. Department of Energy and Iowa State University, Ames, Iowa, which contract grants to the Iowa State University Research Foundation, Inc. the right to apply for this patent.

FIELD OF THE INVENTION

The present invention relates to high conductivity, high strength Cu-Fe composites and, more particularly, to high conductivity, high strength Cu-Fe composites made from Cu and Fe powders using particulate compaction and mechanical deformation techniques.

BACKGROUND OF THE INVENTION

Copper has many important uses in the form of wire, sheet, etc. as a result of its desirable electrical and heat conducting properties. However, pure copper has relatively weak tensile strength. Prior art workers have sought to overcome this deficiency by forming what has been referred to as an "in-situ" composite of Cu and X where X is Nb, Ta, W or other refractory metal. The composite so formed includes elongated strengthening filaments of the X constituent dispersed in a Cu matrix constituent.

"In-situ" Cu-X composites have been produced by a solidification/reduction process wherein a Cu-X melt is cast and solidified to provide a two phase body (e.g., an ingot having X dendrites in a Cu matrix) that is then mechanically reduced (e.g., by swaging, rolling, drawing, etc.) to form the composite. "In-situ" composites have also been produced by a powder compaction/reduction process wherein a mixture of Cu and X powders is initially compacted to densify the particulate mixture and then mechanically reduced to form the composite. The composites produced in these ways are quite ductile and can be mechanically reduced to very large strains without breakage. The mechanical reduction operation converts the X (refractory metal) dendrites or particles, as the case may be, into the strengthening filaments which serve to reinforce and greatly increase the strength of the composite.

Prior art workers have been successful in making Cu-Nb, Cu-Ta and other Cu-X composites using the solidification/reduction process as a result of the quite low solubility of the refractory metal in Cu in the liquid state. However, "in-situ" Cu-Fe composites cannot be produced by the solidification/reduction process with satisfactory electrical and heat conducting properties because the Fe is not sufficiently insoluble in liquid Cu.

One prior art worker has suggested that "in-situ" composites of Cu-Fe as well as Cu-Nb and Cu-V can be made using the solidification/reduction process (e.g., see Bevk et al., "In Situ Composites IV", pp. 121–133, (1982), ed. Lempke, et al., Elsevier Sci. Pub. Co.). However, as mentioned hereinabove, "in-situ" Cu-Fe composites having acceptable electrical and heat conducting properties cannot be made using the solidification/reduction process as a result of the insufficient insolubility of Fe in solid Cu. Furthermore, the present inventors have discovered that the powder compaction/reduction process is not straightforwardly applicable to the production of "in-situ" Cu-Fe composites and, as heretofore practiced, does not provide a viable method for making high strength, high conductivity Cu-F composites.

Since Cu-Fe composites will enjoy a significant cost advantage over the corresponding Cu-X composites as a result of the low cost of Fe compared to the refractory metals, there is a continuing desire to provide "in-situ" high strength, high conductivity Cu-Fe composites and a viable process for making such composites. The present invention has as an object to satisfy this desire.

SUMMARY OF THE INVENTION

The present invention provides an improved compaction/reduction process for making an "in-situ" high strength, high conductivity Cu-Fe composite from a particulate mixture of Cu and Fe. The present invention is based on the discovery that the processing conditions must be so controlled as to prevent dissolution of Fe into the Cu matrix to a harmful extent that significantly and irreversibly degrades the electrical conducting properties of the composite. In particular, the present invention is based on the discovery that the Cu-Fe particulate mixture must be processed (e.g., compacted and mechanically reduced) at temperatures and for times at temperatures selected to avoid such harmful Fe dissolution into the Cu matrix.

In accordance with the method of the invention, an "in-situ" Cu-Fe composite is formed by preparing a particulate mixture of Cu and Fe, a majority of the mixture comprising Cu matrix particulates. The particulate mixture is compacted (e.g., cold isostatically pressed, hot isostatically pressed, hot extruded, etc.) to initially densify the particulate mixture and then optionally cleaned using a hydrogen treatment. The compacted mixture is thereafter mechanically deformed (e.g., swaged, rolled, drawn, etc.) to codeform the Cu and Fe particulates into an "in-situ" composite having elongated Fe strengthening filaments dispersed in a Cu matrix. During these processing steps, the temperature of the particulate mixture and the time at temperature is selected to avoid dissolution of Fe into the Cu matrix to a harmful extent that substantially and irreversibly degrades the electrical conductivity of the composite. Generally, the temperature and time at temperature to avoid harmful dissolution of the Fe into the Cu matrix will depend on the diffusion coefficient of Fe in the Cu matrix, the solubility of the Fe in the Cu matrix, and the relative sizes of the Fe and Cu particulates in the mixture. Preferably, in practicing the method of the present invention, the particulate mixture is maintained at a temperature not exceeding about 500° C. for the times typically involved in carrying out the various processing steps.

The improved "in-situ" Cu-Fe composites of the present invention include a Cu matrix devoid of harmful levels of Fe in solid solution (e.g., not exceeding 0.01 weight % of the Cu matrix) so as to exhibit electrical conducting properties generally equivalent to the more expensive "in-situ" Cu-X (refractory metal) composites at a given ultimate tensile strength level.

DETAILED DESCRIPTION OF THE INVENTION

Figure 1:
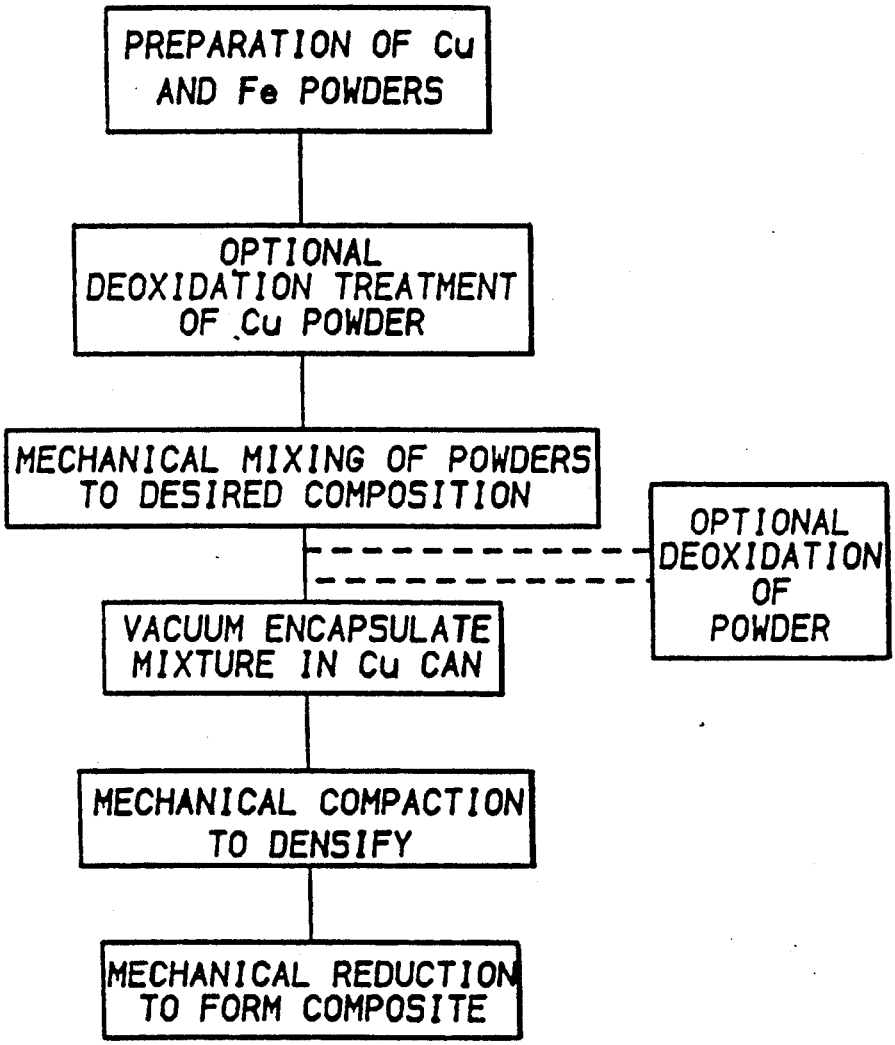
FIG. 1 is a flowsheet illustrating sequential method steps for forming an "in-situ" Cu-Fe composite in accordance with the invention.

Referring to FIG. 1, the various steps involved in practicing one embodiment of the method of the invention are illustrated. In this embodiment, Cu powder of desired size and composition is prepared by the inert gas atomization process described in the Ayers and Anderson U.S. Pat. No. 4,619,845, the teachings of which are incorporated herein by reference. In using the inert gas atomization process to make high purity Cu powder for use in this invention, molten droplets of Cu are formed by melting grade C101 copper and are released into an enclosed chamber having an inert gas (e.g., Ar) atmosphere therein. As the Cu droplets are dispersed into the inert gas atmosphere, they are rapidly solidified, either while gas-borne or by impingement on a cool surface, and collected as high purity Cu powder particles.

The Cu powder prepared by the inert gas atomization process is considered to be of high purity in that total metallic impurities are limited to 0.05% by weight of the powder produced. The Cu powder is prepared in a size range of about −30 to about −325 mesh for use in the invention. A Cu particle size of about −200 mesh is preferred.

Alternately, the Cu powder may be purchased from commercially available sources in the desired size and composition. However, commercially available Cu powder typically must be cleaned before or after mixing with the Fe powder to remove deleterious oxide films from the powder particles. The Cu powder can be cleaned prior to or after mixing with the Fe powder by a hydrogen (deoxidation) treatment. In the event the hydrogen treatment is conducted before mixing with the Fe powder, the Cu powder is subjected to flowing hydrogen at a temperature of about 600° C. for a time of about 2 hours sufficient to remove (i.e., reduce) the oxide film. A treatment for cleaning the Cu powder after it is mixed and compacted with the Fe powder is described below.

The inert gas atomized or as-cleaned purchased Cu powder is maintained under a protective inert gas atmosphere prior to and after mixing with the Fe powder as needed to prevent oxidation thereof prior to subsequent processing steps set forth below.

The Fe powder used in practicing the invention is typically purchased in the desired size and composition as commercially available electrolytic powder (e.g., as grade A-131 Fe powder available from SCM Corp., Cleveland, Ohio), although the Fe powder can be prepared by the inert gas atomization process described above as well as other powder production techniques. The Fe powder is purchased/prepared in a size range of about −30 to about −400 mesh. Preferably, a Fe particle size of about −325 mesh is preferred in practicing the invention. The Fe powder may contain significant levels of other elements added purposely to increase its strength or present as impurities as a result of the powder making technique employed (e.g., lower cost Fe powder making processes may result in a higher level of impurities). For example, the Fe powder may include C and Mn at levels that render the Fe powder a steel powder. Moreover, small amounts of alloyants such as Si, Ni, Mn and other solid solution strengtheners may be present in the Fe powder; e.g., the total content of such alloyants may be up to about 5 weight % of the Fe powder.

Referring to FIG. 1, the Cu powder and the Fe powders described above are mechanically mixed in selected volumetric proportions to provide a starting particulate (powder) mixture. In accordance with the invention, the starting particulate mixture will comprise about 5 v/o (volume %) to about 40 v/o (volume %) of the Fe powder and the balance the Cu powder described above. A more preferred starting particulate mixture is comprised of about 12 v/o to about 18 v/o of the Fe powder with the balance being the Cu powder. An even more preferred starting mixture comprises about 15 v/o of the Fe powder. The Cu and Fe powders are mechanically mixed under a protective inert (e.g., Ar) atmosphere in a conventional "V" blender or mixer at room temperature to provide a uniform distribution of Cu and Fe powders throughout.

The starting particulate mixture is then encapsulated in a sealable container (e.g., a Cu can or polyurethane tube) in preparation for the mechanical compaction step. The particulate-filled container may be evacuated depending upon the mechanical composition step to be employed.

The mechanical compaction step should provide a relatively large increase in the density of the encapsulated starting powder mixture so as to form a compacted powder body amenable to subsequent mechanical reduction. For example, the compacted powder body will have a density of at least about 60% of theoretical after the compaction step depending, of course, on the particular compaction technique used. Preferably, the compacted body will exhibit a density of about 75% to about 85% of theoretical. The compacted bodies produced by the mechanical compaction step function as billets for the subsequent mechanical reduction (deformation processing) step.

Various mechanical compaction techniques may be used in practicing the invention. For example, vibratory compaction, cold (i.e., room temperature) isostatic pressing, hot isostatic pressing, hot extrusion, cold (room temperature) hydrostatic extrusion and like operations (as well as combinations thereof) can be employed. Hot compaction processes, such as hot isostatic pressing and hot extrusion, are preferred for optimum densification, provided that during compaction, the temperature and time at temperature of the particulate mixture are selected to avoid harmful Fe dissolution into the Cu particles for reasons to be explained below. In particular, hot isostatic pressing should be conducted at a temperature of about 500° C. or below for times of about 1 to 5 hours (e.g., 2 hours). A preferred hot isostatic pressing step is conducted at about 500° C. for about 2 hours. Hot extrusion should be conducted at a temperature of about 500° C. or below, preferably at 450° C., using soaking times prior to extrusion as short as possible, (e.g., about 15 minutes).

Although the invention is not limited to any particular compaction process, certain specific compaction processes are described in the Examples set forth below.

In the event the starting particulate mixture includes Cu powder (e.g., as-purchased commercial Cu powder) which has not been previously cleaned of any oxide film present thereon, the compacted body can be subjected to a hydrogen (deoxidation) treatment. The treatment is conducted under temperature and time at temperature conditions effective to remove (reduce) the oxide film on the Cu powder without causing harmful Fe dissolution into the Cu particles. In particular, the compacted powder body can be treated under flowing hydrogen at a temperature of about 300° C. to 500° C., preferably about 500° C., for several hours (e.g., 4 hours) to clean the Cu particles without harmful Fe dissolution therein.

Figure 4A:
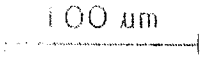
FIGS. 4(A) and (B) are photomicrographs at 250X of a longitudinal and transverse section, respectively, of a Cu-15 v/o Fe composite wire made in accordance with the invention (e.g., see Example 1).
Figure 4B:
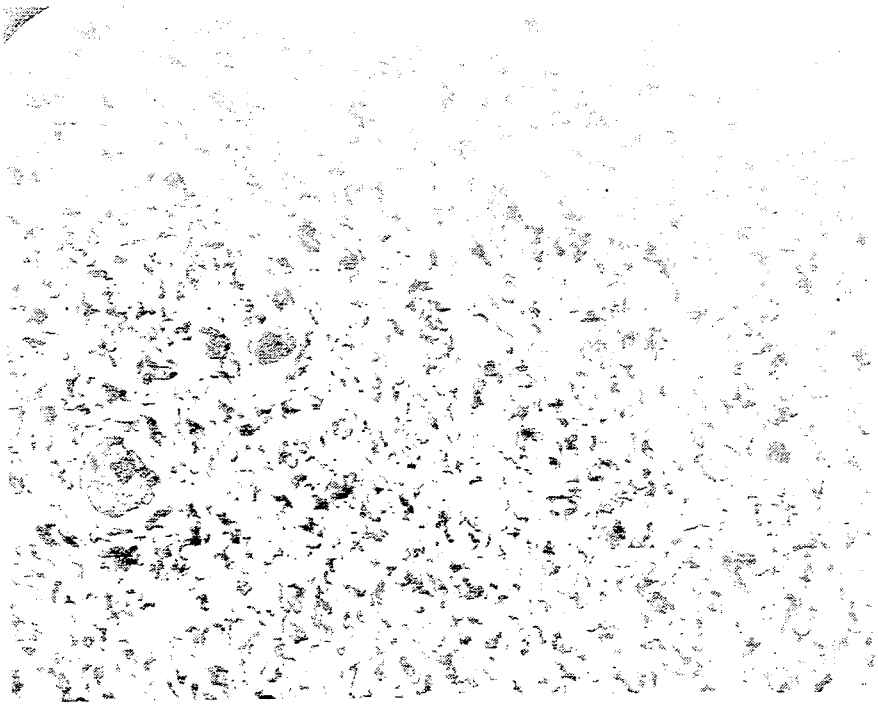

Following the compaction step and optional cleaning step just described, the compacted powder body is subjected to a mechanical deformation (reduction) step to form an "in-situ" Cu-Fe composite having desired composite strength properties resulting from a microstructure comprising a codeformed Cu matrix and ribbon-shaped Fe strengthening filaments dispersed in the matrix; e.g., see FIG. 4 illustrating the microstructure of a Cu-15 v/o Fe composite produced in accordance with the invention as set forth in Example 1.

Those skilled in the art will appreciate that the volume percentage of Fe filaments in the Cu matrix will correspond to the original volume percentage of Fe particles in the starting powder mixture. The observed composite microstructure thus will vary with the volume percentage of Fe filaments in the Cu matrix.

A large percentage reduction in area is used to form the "in-situ" Cu-Fe composite to a desired configuration, such as wire, rod, sheet and the like, and composite strength level. Typically, the reduction in area is described in terms of the parameter $\eta$ which is equal to the natural logarithm of the ratio of the cross-sectional area of the compacted powder body before reduction ($A_o$) to the cross-sectional area after reduction ($A_f$), $\ln(A_o/A_f)$. In general, $\ln [A_o/A_f]$ is at least about 6, preferably about 10.

The mechanical deformation (reduction) process can be carried out in one or more steps using known mechanical size reduction processes, such as swaging, rod rolling, sheet rolling, forging, drawing and like processes (as well as combinations thereof). These reduction processes are preferably carried out at room temperature (e.g., 22° C.). Although not preferred, the mechanical reduction process may be carried out while the compacted body is at elevated temperature, provided that the temperature and time at temperature are selected to avoid harmful Fe dissolution into the Cu matrix for reasons to be explained below. Moreover, the reduction process may be carried out in the ambient atmosphere (i.e., in air) or under a protective inert atmosphere, depending on the temperature of the body during the mechanical reduction process.

Although the invention is not limited to any particular mechanical reduction process, certain specific reduction processes are described in the Examples set forth below.

A so-called bundling technique is particularly useful when larger sized (e.g., −30 to −50 mesh) Cu powder and Fe powder is used (e.g., see Example 5 below) in making the compacted powder body. These larger powders require a larger mechanical reduction to achieve comparable composite strengths. In the bundling technique, a large compacted powder body (e.g., a large diameter bar) is initially mechanically reduced to a modest diameter to achieve an $\eta_1$ of, for example, about 6. The reduced body is then cut into short lengths and the lengths bundled together side-by-side (i.e., their longitudinal axes are parallel). The bundle is placed inside a Cu or other can which is then optionally sealed shut under vacuum. The enclosed bundle is then mechanically reduced again to a still smaller diameter providing, say, an $\eta_2$ of about 6. The total strain imparted is the sum of $\eta_1$, $\eta_2$, $\eta_y$, where $\eta_y$ represents further strain imparted by repeating the bundling and reduction steps. In this way, larger sized Cu and Fe powders can be used in practicing the invention and processed with the larger mechanical reduction necessary to achieve desired composite strength.

In accordance with the invention, the method steps described above are practiced under conditions of temperature and time at temperature that will prevent dissolution of Fe into the Cu matrix to a harmful extent that substantially degrades the electrical and heat conducting properties of the resulting composite. In particular, the invention involves the recognition (a) that Fe can dissolve to harmful extents in the Cu matrix when the powders are intimately commingled in the particulate mixture and thereafter, especially during the hydrogen (deoxidation) treatment step if used, the compaction step, and the mechanical reduction step(s) when conducted at elevated temperatures and (b) that, once dissolved, the Fe is not removed from the Cu matrix upon subsequent cooling to a lower temperature, such as room temperature.

Figure 2:
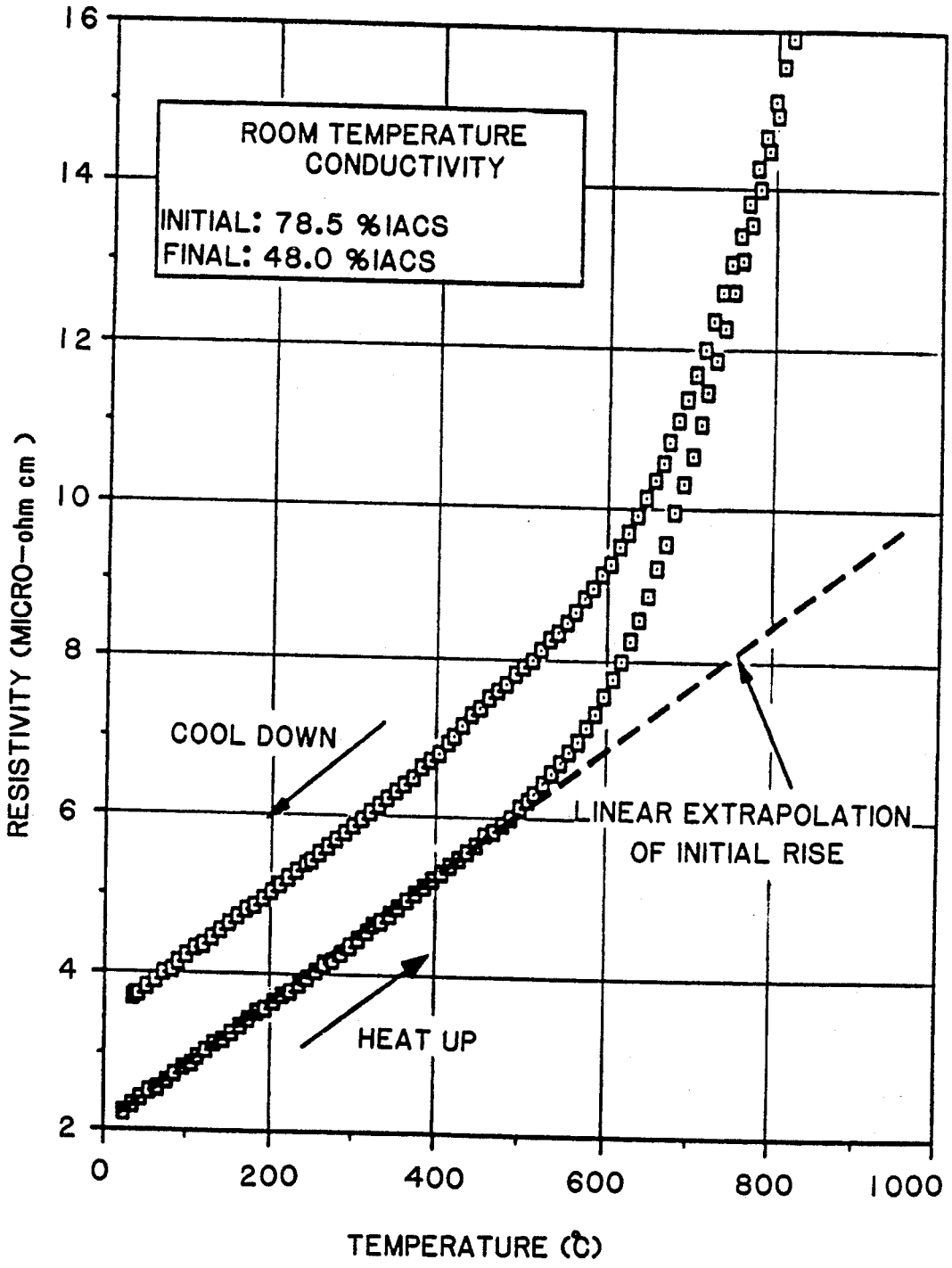
FIG. 2 is a graph of resistivity versus temperature for a Cu-15 v/o Fe composite of the invention.

For example, referring to FIG. 2, the variation of resistivity with temperature of an "in-situ" Cu-15 v/o Fe composite is shown. The Cu-15 v/o Fe composite was a 20 mil diameter wire formed by room temperature swaging and then drawing. The variation of resistivity with temperature was developed by heating the sample of the Cu-15 v/o Fe composite wire progressively to increasing temperatures (heating rate=1° C./min), measuring the electrical resistivity at close intervals during heating using a standard four probe DC technique (e.g., see J. Applied Phys. 65 (1989) p. 1293) and, after heating to 810° C., slowly cooling (e.g., furnace cooling) the sample to room temperature. Resistivity is also measured at close intervals as the sample cools. The arrow (FIG. 2) pointing up indicates resistivity measurements made on the heating cycle, and the arrow pointing down indicates measurements made on the cooling cycle. The electrical resistivity and ultimate tensile strength of several such tested (heat treated) Cu-15 v/o Fe composite samples were also measured at room temperature (R.T.). The resistivity may be converted to electrical conductivity by dividing 1.72 by the resistivity having units of microohm-cm and multiplying by 100. The resulting conductivity is called % IACS (Percent International Copper Standard) and pure Cu has the value of 101%. The measured electrical conductivity (R.T.) of the composite was compared to the initial pre-test electrical conductivity (R.T.) of the composite (e.g., see upper left corner of FIG. 2 for comparisons.

As shown in FIG. 2, as the Cu-15 v/o Fe composite is subjected to higher test temperatures, the measured resistivity begins to rise linearly. At temperatures beginning at about 500° C., the measured resistivity rises very significantly. This rise in resistivity is attributable to the dissolution of Fe into the Cu matrix.

Moreover, it is apparent that after the Cu-15 v/o Fe composite is heated and then slowly cooled to R.T., its measured electrical resistivity does not return to the original room temperature value but instead remains at a significantly higher value. This irreversible increase in resistivity is attributed to the inability of the Fe dissolved in solid solution during the high temperature resistivity test heat treatment to precipitate out of solid solution in the Cu matrix upon slow cooling to R.T.

As is apparent from FIG. 2, the conductivity of the Cu-15 v/o Fe composite is significantly decreased by dissolution of Fe in the Cu matrix. For example, the initial measured conductivity of the composite of about 78.5% IACS decreased to a measured conductivity of only 48.0% IACS after the 810° C. heating/cooling test cycle. As a result, it is important in practicing the invention to avoid dissolution of harmful amounts of Fe into the Cu matrix as the Cu-Fe particulate mixture is processed. In general, the amount of Fe dissolved in solid solution in the Cu matrix should not exceed about 0.01 weight % of the Cu matrix in order to avoid substantially degrading the electrical and heat conducting properties of the Cu-Fe composite.

The temperature and time at temperature conditions of processing the Cu-Fe mixture to form the desired "in-situ" composite without harmful Fe dissolution into the Cu matrix will depend upon several factors; namely, the diffusion coefficient of Fe in Cu, the solubility of Fe in Cu and the size of the Fe particles in the Cu constituent (Cu particles or matrix). In general, in practicing the processing steps described above, the Cu-Fe particulate mixture should be maintained at a temperature of about 500° C. or lower for the times typically involved in carrying out the processing steps.

The following Examples are offered to illustrate the invention in further detail without limiting the scope thereof.

EXAMPLE 1

1. A starting powder mixture was prepared by blending 85 v/o Cu powder and 15 v/o Fe powder together. The Cu powder was prepared from grade C101 copper using the inert gas atomization process referred to hereinabove. A Cu powder size of −200 mesh was used. The Fe powder was commercially available electrolytic powder of −325 mesh size. The Cu powder was stored under an inert atmosphere before mixing with the Fe powder. The starting powder mixture was also blended and stored under an inert atmosphere until vacuum encapsulation in step 2 below.

2. The starting powder mixture was vacuum encapsulated in a Cu can. The powder filled can was cold (R.T.) isostatically pressed (CIP) at 50 ksi and then hot isostatically pressed (HIP) at 500° C. and 45 ksi pressure for a hold time at temperature and pressure of 2 hours. The CIP and HIP compaction yielded a one inch diameter compacted bar or rod having a density of 95% of theoretical.

3. The one inch compacted bar was then mechanically reduced by a combination of room temperature swaging followed by cold (room temperature) drawing to provide a Cu-15 v/o Fe composite wire of 0.050 inch diameter. FIG. 4 is a photomicrograph of the microstructure of the Cu-15 v/o Fe composite so produced and shows the Cu matrix (light phase) and Fe strengthening filaments (dark phase) dispersed in the matrix.

Figure 3:
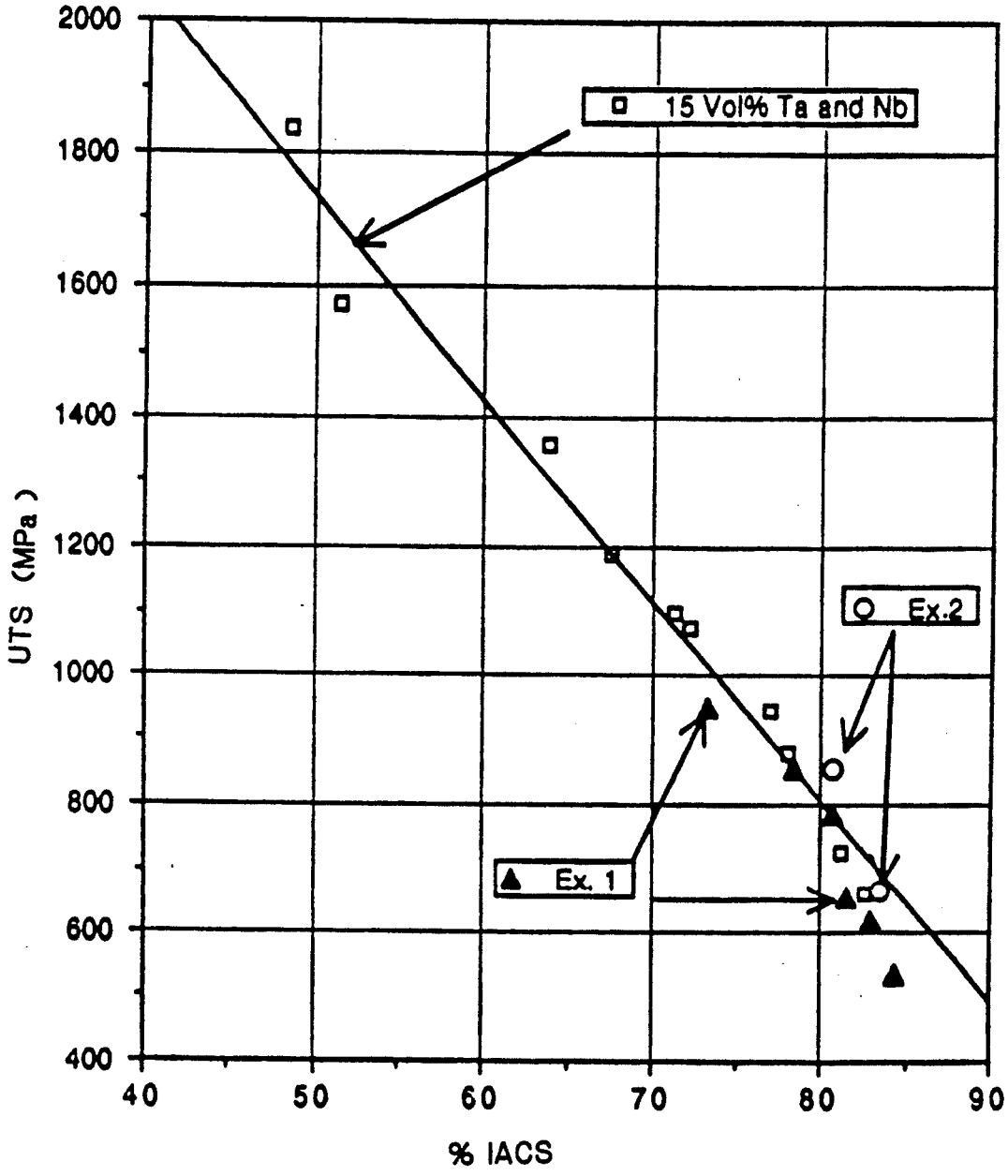
FIG. 3 is a graph of ultimate tensile strength versus conductivity of the Cu-15 v/o Fe composite of Example 1 (Ex.1) and Example 2 (Ex.2) as well as of a Cu-15 v/o Nb composite and a Cu-15 v/o Ta composite for comparison purposes.

4. The ultimate tensile strength (UTS) and the room temperature electrical conductivity (IACS) of the Cu-15 v/o Fe composite wire were measured at various levels of reduction. FIG. 3 represents a least square fit plot of the measured ultimate tensile strength and electrical conductivity. Similar data measured on "in-situ" Cu-15 v/o Nb and Cu-15 v/o Ta composites is included for comparison. These composites were prepared by a solidification/ reduction process wherein a 2.5 inch diameter rod was mechanically reduced to a diameter as small as 10 mils by cold deformation (i.e., rod rolling and drawing).

FIG. 3 illustrates that the "in-situ" Cu-15 v/o Fe composite wire produced in accordance with the invention exhibited, at a given ultimate tensile strength, an electrical conductivity generally equivalent to that exhibited by the much more costly Cu-Nb and Cu-Ta composites.

EXAMPLE 2

The same processing procedure was used as in Example 1 except that step 2 was changed. Instead of compacting the starting powder mixture by CIP plus HIP, the mixture was compacted by hot extrusion. In particular, the powder mixture was placed in a 2 inch diameter Cu extrusion can and vacuum outgassed at 475° C. for 2 hours. The extrusion can was then welded shut in an electron beam welder. The can and its contents were then hot extruded at 480° C. to rod of diameter 0.53 inch. Steps 3 and 4 were similar to Example 1 and the resulting ultimate tensile strength versus electrical conductivity data (not shown) for the resulting Cu-15 v/o Fe composite was similar to the data of Example 1 as shown on FIG. 3.

EXAMPLE 3

The same processing procedure was used as in Example 1 except that (a) a commercially purchased Cu powder (available as grade 500-RL from SCM Corp., Cleveland, Ohio) was mixed with the Fe powder and (b) the starting powder mixture was subjected to a preliminary compaction to 60% of theoretical density by vibratory compaction. Because an oxide film was present on the purchased Cu powder, the preliminarily-compacted starting powder mixture was subjected to a hydrogen (deoxidation) treatment wherein the compacted powder body was first outgassed at 150° C. for 4 hours and then treated under flowing hydrogen at 500° C. for 4 hours. After this treatment, the compacted body was handled under inert atmosphere conditions until vacuum encapsulation in a Cu can. Steps 2 through 4 were then carried out in the same manner as set forth in Example 1 to produce an "in-situ" Cu-15 v/o Fe composite. The resulting ultimate tensile strength versus reduction strain, $\eta$, was very similar to examples 1 and 2. The electrical conductivity versus reduction strain, $\eta$, was lower than was found in examples 1 and 2. The reason for the lower conductivity in this material was traced to the higher Fe impurity content of the starting commercial Cu powder. It is believed that if a commercial Cu powder were used which has an iron impurity level in the acceptable range of less than 0.01 parts per million, results similar to examples 1 and 2 would be obtained. Such a commercial powder is currently available, grade 185E/500 from ALCAN, Union, N.J.

EXAMPLE 4

The same processing procedure was used as in Example 3 except that the commercial Cu powder was hydrogen treated prior to mixing with the Fe powder. The hydrogen treatment was conducted at a temperature of 600° C. under flowing hydrogen for 4 hours. All powder handling prior to and after mixing of the starting powder mixture (i.e., prior to vacuum encapsulation) was carried out under an inert atmosphere. The starting powder mixture was processed according to Steps 2 through 4 of Example 1 to provide an "in-situ" Cu-15 v/o Fe composite. The resulting ultimate tensile strength versus reduction strain, $\eta$, was very similar to examples 1 and 2. The electrical conductivity versus reduction strain, $\eta$, was lower than was found in examples 1 and 2. The reason for the lower conductivity in this material was traced to the higher Fe impurity content of the starting commercial Cu powder. It is believed that if a commercial Cu powder were used which has an iron impurity level in the acceptable range of less than 0.01 parts per million, results similar to examples 1 and 2 would be obtained. Such a commercial powder is currently available, grade 185E/500 from ALCAN, Union, N.J.

While the invention has been described in terms of specific embodiments thereof, it is not intended to be limited thereto but rather only to the extent set forth in the following claims.

We claim:

1. A method of forming a Cu-Fe composite, comprising the steps of:

a) preparing a particulate mixture of Cu and Fe wherein a majority of said mixture comprises Cu matrix particulates, b) compacting the particulate mixture to increase the density thereof, c) mechanically deforming the compacted particulate mixture to form a composite having Fe strengthening filaments dispersed in a Cu matrix, and d) conducting steps a), b) and c) at a temperature of said mixture and time at temperature selected to avoid dissolution of Fe into the Cu matrix particulates to a harmful extent that substantially degrades the electrical conductivity of said composite.

2. The method of claim 1 wherein the temperature of said particulate mixture does not exceed about 500° C. during steps (a), (b) and (c).

3. The method of claim 1 including the further step, after step (a) and before step (b), of heating the particulate mixture at a temperature not exceeding about 500° C. in a reducing atmosphere.

4. The method of claim 1 including the further step, before step (a), of heating the Cu particulates to a temperature up to about 600° C. in a reducing atmosphere.

5. The method of claim 1 wherein said mixture comprises about 5 volume % to about 40 volume % Fe particulates and the balance Cu particulates.

6. The method of claim 4 wherein said mixture comprises about 12 volume % to about 18 volume % Fe particulates and the balance Cu particulates.

7. The method of claim 1 wherein said mixture is prepared with Cu particulates having a size of about −30 to about −325 mesh and with Fe particulates having a size of about −30 to about −400 mesh.

8. The method of claim 7 wherein the Cu particulates have a size of about −200 mesh and the Fe particulates have a size of about −325 mesh.

9. The method of claim 1 wherein said mixture is compacted in step (b) at a temperature not exceeding about 500° C.

10. The method of claim 9 wherein said mixture is compacted by isostatic pressing.

11. The method of claim 9 wherein said mixture is compacted by extrusion.

12. The method of claim 1 wherein said compacted mixture is mechanically deformed in step (c) by swaging or drawing.

13. The method of claim 1 wherein said compacted mixture is mechanically deformed in step (c) by rolling to produce a sheet product.

14. The method of claim 1 wherein said compacted mixture is deformed in step(c) to form a composite body, the body is cut into lengths, the lengths are bundled together and the bundled lengths are mechanically deformed.

* * * * *